US009805858B2

(12) United States Patent
Sakamoto

(10) Patent No.: US 9,805,858 B2
(45) Date of Patent: Oct. 31, 2017

(54) COIL COMPONENT, COIL COMPONENT COMPLEX, TRANSFORMER, AND POWER SUPPLY UNIT

(71) Applicant: TDK CORPORATION, Tokyo (JP)

(72) Inventor: Takuya Sakamoto, Minato-ku (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/801,667

(22) Filed: Jul. 16, 2015

(65) Prior Publication Data

US 2016/0027570 A1 Jan. 28, 2016

(30) Foreign Application Priority Data

Jul. 28, 2014 (JP) ..... 2014-152696

(51) Int. Cl.
*H01F 21/02* (2006.01)
*H01F 27/28* (2006.01)

(52) U.S. Cl.
CPC . *H01F 27/2804* (2013.01); *H01F 2027/2809* (2013.01)

(58) Field of Classification Search
CPC ..... H01F 27/2804; H01F 2027/2809; H01F 21/04; H01F 21/12; H01F 2021/125; H01F 29/02; H01F 29/025; H01F 29/04; H01F 29/12
USPC ..... 336/200, 137–147, 10, 116, 150
See application file for complete search history.

(56) References Cited

U.S. PATENT DOCUMENTS

| | | | | |
|---|---|---|---|---|
| 6,404,317 | B1 | 6/2002 | Mizoguchi et al. | |
| 6,590,486 | B2 | 7/2003 | Tanaka et al. | |
| 8,334,747 | B2 * | 12/2012 | Matsumoto | H01F 27/22 336/200 |
| 2007/0115086 | A1 * | 5/2007 | Cairo Molins | H01F 21/12 336/200 |
| 2009/0195343 | A1 * | 8/2009 | Tiemeijer | H01F 17/0006 336/200 |
| 2013/0038387 | A1 | 2/2013 | Schmidhammer et al. | |

FOREIGN PATENT DOCUMENTS

| | | | |
|---|---|---|---|
| CN | 102474187 | A | 5/2012 |
| JP | H03-183106 | A | 8/1991 |
| JP | H08-69935 | A | 3/1996 |
| JP | H09-92537 | A | 4/1997 |
| JP | 2000-260620 | A | 9/2000 |
| JP | 2013-026556 | A | 2/2013 |

OTHER PUBLICATIONS

Jul. 7, 2016 Office Action issued in German Application No. 102015112211.1.

* cited by examiner

*Primary Examiner* — Mangtin Lian
(74) *Attorney, Agent, or Firm* — Oliff PLC

(57) ABSTRACT

Provided is a coil component that includes: a coil pattern provided on a substrate and including a plurality of separated end sections that are separated from each other with a gap in between; and a conduction member that allows a selective electrical conduction between the respective separated end sections. The selective electrical conduction causes a change in the number of turns of the coil pattern. Every section in the coil pattern configures a part of the coil component, irrespective of the number of turns.

16 Claims, 16 Drawing Sheets

| EXAMPLE OF VOLTAGE OF HV BATTERY | CLASSIFICATION BY VEHICLE SIZE | CLASSIFICATION BY STRUCTURE | EXAMPLE OF THE NUMBER OF TURNS OF ISOLATION TRANSFORMER |
|---|---|---|---|
| 100 V TO 200 V | SMALL-SIZED VEHICLE | MILD HEV | 8 TURNS |
| 200 V TO 300 V | MEDIUM-SIZED VEHICLE | FULL HEV | 10 TURNS |
| 300 V TO 400 V | LARGE-SIZED VEHICLE | BATTERY HEV | 12 TURNS |

FIG. 16

COIL COMPONENT, COIL COMPONENT COMPLEX, TRANSFORMER, AND POWER SUPPLY UNIT

CROSS REFERENCE TO RELATED APPLICATIONS

This application claims the benefit of Japanese Priority Patent Application JP2014-152696 filed on Jul. 28, 2014, the entire contents of which are incorporated herein by reference.

BACKGROUND

The invention relates to a coil component, a coil component complex, and a transformer each provided on a printed circuit board, and to a power supply unit that includes such a coil component and so forth.

In recent years, a wide range of ecologically-friendly vehicles, from high-end grade ones to regular grade ones, have been released from various automobile suppliers. The ecologically-friendly vehicles may be typified by hybrid vehicles. In such ecologically-friendly vehicles, a high-voltage hybrid (HV) battery in a range from about 100 V to about 400 V is mounted as an electrical energy source for storing electrical energy used for traveling. For example, reference is made to Japanese Unexamined Patent Application Publication Nos. H08-69935 (JP-H08-69935A), H09-92537 (JP-H09-92537A), 2013-26556 (JP2013-26556A), and H03-183106 (H03-183106A), and Japanese Patent No. 3223425 (JP3223425B).

SUMMARY

HV batteries have their respective battery voltages that vary in various ways depending on their intended use, price range, vehicle size, and grade. A voltage range is typically as illustrated in FIG. 16 by way of example. Referring to FIG. 16, voltages ranging from 100 V to 200 V, 200 V to 300 V, and 300 V to 400 V may be used for the HV batteries, for example.

Besides the HV battery, the ecologically-friendly vehicles are each mounted with a 12 V lead battery for operating electric components. An in-vehicle DC-DC converter serves to convert the HV battery voltage into a battery voltage for the lead battery. A matching transformer (MT), or an "isolation transformer", is used for the DC-DC converter for power conversion and isolation. The optimal number of turns of a coil in the isolation transformer depends on the voltage range of the HV battery as illustrated by way of example in FIG. 16. For example, in order to support the three voltage ranges as described above, isolation transformers that are different in number of turns from each other have to be prepared individually in existing cases. In the example illustrated in FIG. 16, the numbers of turns are 8 turns (8 Ts) for the voltage range from 100 V to 200 V, 10 turns (10 Ts) for the voltage range from 200 V to 300 V, and 12 turns (12 Ts) for the voltage range from 300 V to 400 V.

JP-H08-69935A, JP-H09-92537A, JP3223425B, JP2013-26556A, and H03-183106A each disclose an example in which a coil component is configured by a conductor coil pattern. Some of them disclose a configuration example in which the number of turns of the coil component is made variable. However, there is room for improvement in the coil components described in JP-H08-69935A, JP-H09-92537A, JP3223425B, JP2013-26556A, and H03-183106A, in that a plurality of substrates different in the number of turns from each other have to be prepared in JP-H08-69935A, in that patterns that do not function as a coil and thus are wasted are present when the number of turns is varied in JP-H09-92537A, and so forth, for example.

It is desirable to provide a coil component, a coil component complex, and a transformer each of which makes it possible to vary the number of turns easily, and a power supply unit that includes a power supply circuit device configured by such a coil component or the like.

A coil component according to an embodiment of the invention includes: a coil pattern provided on a substrate and including a plurality of separated end sections that are separated from each other with a gap in between; and a conduction member that allows a selective electrical conduction between the respective separated end sections. The selective electrical conduction causes a change in the number of turns of the coil pattern. Every section in the coil pattern configures a part of the coil component, irrespective of the number of turns.

A transformer according to an embodiment of the invention includes: a primary winding; and a secondary winding. One of the primary winding and the secondary winding includes: a coil pattern provided on a substrate and including a plurality of separated end sections that are separated from each other with a gap in between; and a conduction member that allows a selective electrical conduction between the respective separated end sections. The selective electrical conduction causes a change in the number of turns of the coil pattern. Every section in the coil pattern configures a part of the coil component, irrespective of the number of turns.

A coil component complex according to an embodiment of the invention includes: a first coil component; and a second coil component electrically coupled to the first coil component. The first coil component includes: a coil pattern provided on a substrate and including a plurality of separated end sections that are separated from each other with a gap in between; and a conduction member that allows a selective electrical conduction between the respective separated end sections. The selective electrical conduction causes a change in the number of turns of the coil pattern. Every section in the coil pattern configures a part of the coil component, irrespective of the number of turns.

A power supply unit according to an embodiment of the invention includes a power supply circuit device configured by a coil component. The coil component includes: a coil pattern provided on a substrate and including a plurality of separated end sections that are separated from each other with a gap in between; and a conduction member that allows a selective electrical conduction between the respective separated end sections. The selective electrical conduction causes a change in the number of turns of the coil pattern. Every section in the coil pattern configures a part of the coil component, irrespective of the number of turns.

In the coil component, the coil component complex, the transformer, and the power supply unit according to the embodiments described above, the separated end sections are brought into electrical conduction with each other selectively to vary the number of turns of the coil pattern, whereby every section in the coil pattern configures a part of the coil component, irrespective of the number of turns.

In the coil component, the coil component complex, the transformer, and the power supply unit according to the embodiments described above, the separated end sections are brought into electrical conduction with each other selectively to vary the number of turns of the coil pattern. Upon the variation in the number of turns of the coil pattern, every section in the coil pattern configures a part of the coil component, irrespective of the number of turns. Hence, it is possible to vary the number of turns easily, without the necessity of preparing a plurality of substrates or causing a wasted pattern irrespective of the variation in the number of turns.

It is to be understood that both the foregoing general description and the following detailed description are exemplary, and are intended to provide further explanation of the invention as claimed. Also, effects of the invention are not limited to those described above. Effects achieved by the invention may be those that are different from the above-described effects, or may include other effects in addition to those described above.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the invention.

FIG. 16 describes an example of a relationship of a voltage range of an HV battery versus the number of turns of an isolation transformer.

DETAILED DESCRIPTION

In the following, some example embodiments of the invention are described in detail with reference to the accompanying drawings. Note that the following description and the accompanying drawings are directed to illustrative examples of the invention and not to be construed as limiting to the invention. The description is given in the following order.

1. Switching Power Supply Unit
   1.1 Configuration
   1.2 Operation
2. Coil Component (Transformer 20)
   2.1 Configuration and Action
   2.2 Effect
3. Modification Example of Coil Component
4. Other Embodiments

[1. Switching Power Supply Unit]

[1.1 Configuration]

Figure 1:
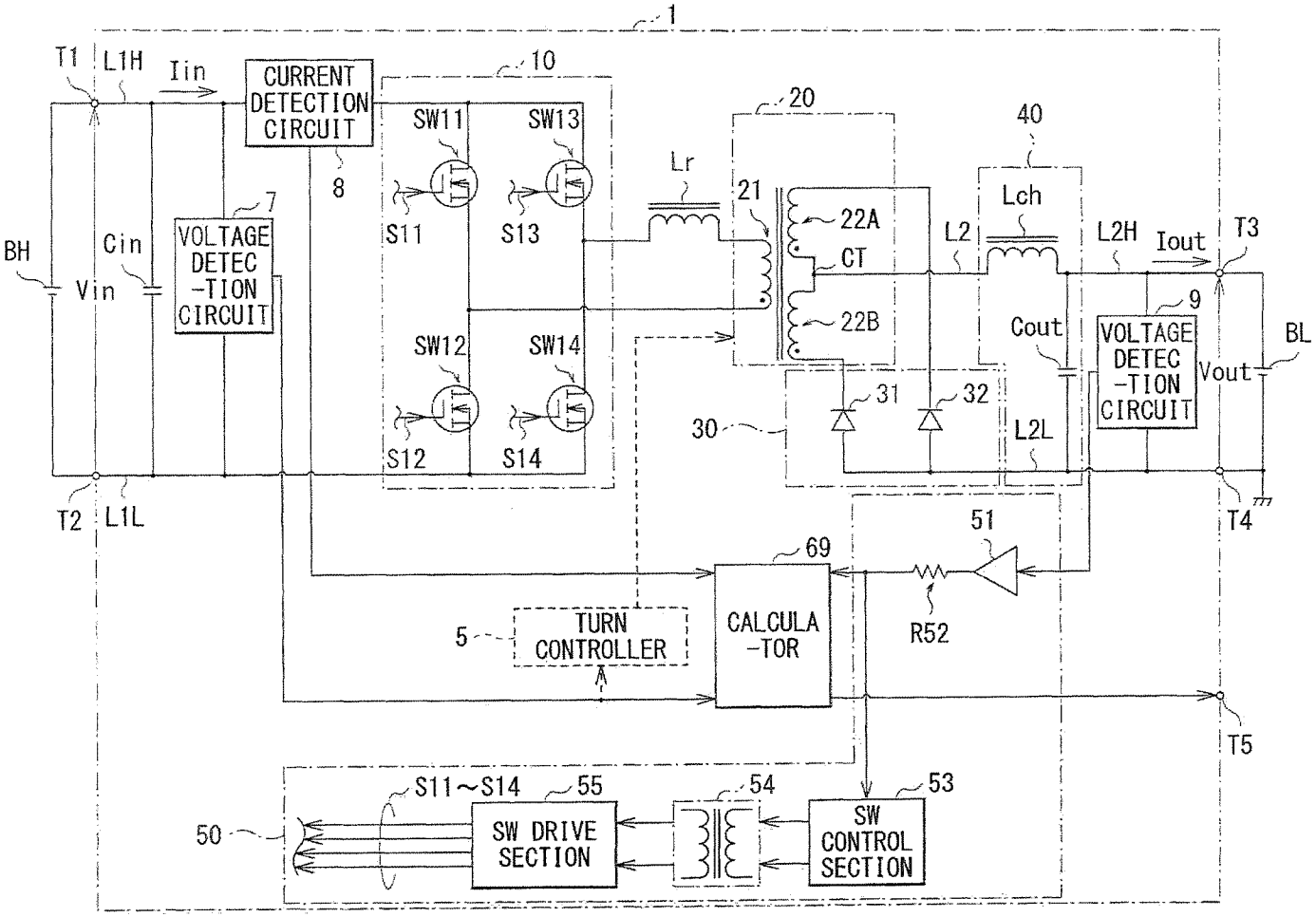
FIG. 1 is a block diagram illustrating an example of a configuration of a power supply unit according to an embodiment of the invention.

FIG. 1 illustrates an example of a configuration of a switching power supply unit 1 according to an embodiment of the invention.

The switching power supply unit 1 may be used as, for example but not limited to, an in-vehicle DC-DC converter. The switching power supply unit 1 may perform a voltage conversion (such as step-down) of a direct-current voltage Vin to generate a direct-current output voltage Vout, and supply the thus-generated output voltage Vout to a low-voltage battery BL through output terminals T3 and T4. The direct-current voltage Vin may be supplied from a high-voltage battery BH coupled to input terminals T1 and T2. The high-voltage battery BH may be a battery that stores electrical energy having a voltage in a range from about 100 V to about 500V. The low-voltage battery BL may be a battery that stores electrical energy having a voltage in a range from about 12 V to about 15 V.

The switching power supply unit 1 may include an input smoothing capacitor Cin, a turn controller 5, voltage detection circuits 7 and 9, a current detection circuit 8, a switching circuit 10, a resonance inductor Lr, a transformer 20 (such as an isolation transformer), a rectifying circuit 30, a smoothing circuit 40, a controller 50, and a calculator 69.

The input smoothing capacitor Cin may be provided between a primary high-voltage line L1H and a primary low-voltage line L1L, and serve to smooth the direct-current input voltage Vin supplied across the input terminals T1 and T2 from the high-voltage battery BH. The primary high-voltage line L1H may be coupled to the input terminal T1. The primary low-voltage line L1L may be coupled to the input terminal T2.

The voltage detection circuit 7 may be provided between the primary high-voltage line L1H and the primary low-voltage line L1L, and serve to detect the input voltage Vin that is across the input terminals T1 and T2 and output a detection signal corresponding to the detected input voltage Vin to the calculator 69. For example, the voltage detection circuit 7 may have a non-limiting circuit configuration in which a voltage is detected through an unillustrated voltage divider resistor provided between the primary high-voltage line L1H and the primary low-voltage line L1L and a voltage corresponding to the detected voltage is generated.

The current detection circuit 8 may be provided between the input terminal T1 and the switching circuit 10 on the primary high-voltage line L1H, and serve to detect an input current Iin that flows along the primary high-voltage line L1H and output a detection signal corresponding to the detected input current Iin to the calculator 69. For example, the current detection circuit 8 may have a non-limiting circuit configuration that includes a current transformer.

The switching circuit 10 may be a full-bridge switching circuit that converts the input voltage Vin into an alternating-current voltage. The switching circuit 10 may include switching devices SW11 to SW14.

The switching devices SW11 to SW14 each may be a device such as, but not limited to, a metal oxide semiconductor-field effect transistor (MOS-FET), a insulated gate bipolar transistor (IGBT), or any other suitable device. In the present example embodiment, all of the switching devices SW11 to SW14 may be N-channel MOS-FETs. The switching device SW11 may have a gate supplied with a SW control signal S11, a source coupled to a drain of the switching device SW12, and a drain coupled to the primary high-voltage line L1H. The switching device SW12 may have a gate supplied with a SW control signal S12, a source coupled to the primary low-voltage line L1L, and the drain coupled to the source of the switching device SW11. The switching device SW13 may have a gate supplied with a SW control signal S13, a source coupled to a drain of the switching device SW14, and a drain coupled to the primary high-voltage line L1H. The switching device SW14 may have a gate supplied with a SW control signal S14, a source coupled to the primary low-voltage line L1L, and the drain coupled to the source of the switching device SW13. Also, the source of the switching device SW11 and the drain of the switching device SW12 may be coupled to a first end of a primary winding 21 of the transformer 20. The source of the switching device SW13 and the drain of the switching device SW14 may be coupled, through the resonance inductor Lr, to a second end of the primary winding 21 of the transformer 20. The resonance inductor Lr may serve to structure, together with parasitic capacitors in the switching devices SW11 to SW14 and a leakage inductor of the transformer 20, a predetermined LC resonance circuit.

With this configuration, the switching circuit 10 may turn on and off the switching devices SW11 to SW14 in response to their respective SW control signals S11 to S14 supplied from a SW drive section 55 in the controller 50, to convert the input voltage Vin into the alternating-current voltage.

The transformer 20 may isolate a primary side and a secondary side from each other in DC, and couple the primary side and the secondary side to each other in AC. The transformer 20 may be a three-winding transformer including the primary winding 21 and secondary windings 22A and 22B. The primary winding 21 of the transformer 20 may be coupled to the secondary windings 22A and 22B of the transformer 20, based on a forward connection. The first end of the primary winding 21 may be coupled to the switching circuit 10. The second end of the primary winding 21 may be coupled to the switching circuit 10 through the resonance inductor Lr. A first end of the secondary winding 22A and a first end of the secondary winding 22B may be coupled to the rectifying circuit 30. A second end of the secondary winding 22A and a second end of the secondary winding 22B may be coupled to each other at a center tap CT to be coupled further to a secondary high-voltage line L2H.

The number of turns of the primary winding 21 may be defined as Np, whereas the number of turns of each of the secondary windings 22A and 22B may be defined as Ns. A ratio Np:Ns of the number of turns of the primary winding 21 to the number of turns of each of the secondary windings 22A and 22B may be, for example but not limited to, 10:1. Note, however, that the number of turns Np of the primary winding 21 of the transformer 20 is made variable, and the number of turns Np is set to any number on an as-needed basis. The turn controller 5 may control the number of turns Np of the primary winding 21 of the transformer 20 in one embodiment where the number of turns Np is variably controllable as described later. For example, the turn controller 5 may control the number of turns Np of the primary winding 21 of the transformer 20, based on the detection signal that corresponds to the input voltage Vin detected by the voltage detection circuit 7.

With this configuration, the transformer 20 may step down the alternating current voltage supplied across the both ends of the primary winding 21 to an alternating-current voltage that is Ns/Np times less than the supplied alternating current voltage, and output the stepped down alternating-current voltage from the secondary windings 22A and 22B.

The rectifying circuit 30 may rectify the alternating current voltage supplied from the transformer 20. The rectifying circuit 30 may include diodes 31 and 32. The diode 31 may have a cathode coupled to the first end of the secondary winding 22B, and an anode coupled to a secondary low-voltage line L2L. The diode 32 may have a cathode coupled to the first end of the secondary winding 22A, and an anode coupled to the secondary low-voltage line L2L.

The smoothing circuit 40 may include a choke coil Lch and an output smoothing capacitor Cout. The choke coil Lch may be so inserted as to be provided on the secondary high-voltage line L2H, and have a first end coupled to the center tap CT of the transformer 20, and a second end coupled to the terminal T3. The output smoothing capacitor Cout may be provided between the secondary high-voltage line L2H and the secondary low-voltage line L2L. The secondary high-voltage line L2H may be coupled to the terminal T3, and the secondary low-voltage line L2L may be coupled to the terminal T4.

With this configuration, the smoothing circuit 40 may smooth a signal rectified by the rectifying circuit 30 and outputted from the center tap CT to generate the direct-current output voltage Vout, and supply the output voltage Vout to the low-voltage battery BL. The low-voltage battery BL may be coupled between the output terminals T3 and T4.

The voltage detection circuit 9 may be provided between the secondary high-voltage line L2H and the secondary low-voltage line L2L, and serve to detect the output voltage Vout that is across the output terminals T3 and T4 and output a detection signal corresponding to the detected output voltage Vout to the controller 50. As with the voltage detection circuit 7, the voltage detection circuit 9 may have a non-limiting circuit configuration in which a voltage is detected through an unillustrated voltage divider resistor provided between the secondary high-voltage line L2H and the secondary low-voltage line L2L and a voltage corresponding to the detected voltage is generated, for example.

The controller 50 may so control, based on the detection result of the output voltage Vout derived from the voltage detection circuit 9, the switching operation performed in the switching circuit 10 as to cause the output voltage Vout to maintain a predetermined voltage level. The controller 50 may include a buffer 51, a resistor R52, a SW control section 53, a transformer 54, and the SW drive section 55.

The buffer 51 may have a function of performing impedance conversion, and may convert a voltage range of the signal supplied from the voltage detection circuit 9 to output a voltage-range-converted signal, for example. The resistor R52 may have a function of removing a noise in the output signal supplied from the buffer 51, and/or limiting factors such as a surge voltage and an overcurrent to protect the buffer 51 and the calculator 69. The SW control section 53 may so control the SW drive section 55 as to cause the output voltage Vout to maintain a predetermined voltage level, based on the signal supplied through the resistor R52 from the buffer 51. More specifically, the SW control section 53 may have a function of generating control signals that serve as basic signals of the respective SW control signals S11 to S14, and supplying the generated control signals to the SW drive section 55 through the transformer 54. The SW drive section 55 may generate the SW control signals S11 to S14, based on the control signals supplied through the transformer 54 from the SW control section 53, and respectively supply the generated SW control signals S11 to S14 to the switching devices SW11 to SW14 of the switching circuit 10.

With this configuration, the switching circuit 10 may perform the switching operation on the basis of the SW control signals S11 to S14, whereby the switching power supply unit 1 may so operate as to cause the output voltage Vout to maintain the predetermined voltage level.

The calculator 69 may determine an output current Iout, based on the input voltage Vin, the output voltage Vout, and the input current Iin, and supply these four pieces of information to the outside. In other words, the switching power supply unit 1 may determine the output current Iout by calculation, based on the input voltage Vin, the output voltage Vout, and the input current Iin, without providing, at the secondary high-voltage line L2H, a current detection circuit that detects the output current Iout.

The calculator 69 may perform the calculation, based on the detection signal corresponding to the input current Iin, the detection signal corresponding to the input voltage Vin, and a voltage that is related to the output voltage Vout and supplied from the buffer 51, to determine the output current Iout. For example, the calculator 69 may determine a switching duty ratio D, based on the input voltage Vin and the output voltage Vout, to determine the output current Iout, based on the input current Iin and the determined switching duty ratio D. Further, the calculator 69 may send the pieces of information on the input voltage Vin, the output voltage Vout, the input current Iin, and the output current Iout to an external unit coupled to the terminal T5. The external unit may be, for example but not limited to, a control unit that controls a system as a whole to which the switching power supply unit 1 belongs and collects pieces of data on states of the switching power supply unit 1 (such as input and output voltages, input and output currents, and a temperature) for purpose of monitoring the states of the switching power supply unit 1. Non-limiting example of such a control unit may be an in-vehicle controller referred to as an electric control unit (ECU).

The calculator 69 may be configured using a controller such as, but not limited to, a microcontroller (MCU). For example, besides the calculator 69, the SW control section 53 or a part of the SW control section 53 may be achieved using a controller such as, but not limited to, the microcomputer.

[1.2 Operation]

A description is now given of an outline of an overall operation of the switching power supply unit 1. The switching circuit 10 may perform the switching of the switching devices SW11 to SW14 on the basis of the respective SW control signals S11 to S14 to convert the direct-current voltage Vin supplied from the high-voltage battery BH into the alternating-current voltage, and supply the thus-converted alternating-current voltage across the both ends of the primary winding 21 of the transformer 20. The transformer 20 may convert (such as step down) the alternating current voltage into the alternating-current voltage that is Ns/Np times less than the supplied alternating current voltage, and output the voltage-converted alternating-current voltage from the secondary windings 22A and 22B. The rectifying circuit 30 may rectify the outputted alternating current voltage. The smoothing circuit 40 may smooth the rectified signal to generate the direct-current output voltage Vout, and supply the output voltage Vout to the low-voltage battery BL that may be coupled between the output terminals T3 and T4.

The controller 50 may generate the SW control signals S11 to S14 on the basis of the detection result of the output voltage Vout derived from the voltage detection circuit 9 and supply the generated SW control signals S11 to S14 to the switching circuit 10, to so control the switching circuit 10 as to cause the output voltage Vout to maintain the predetermined voltage level. The calculator 69 may determine the output current Iout on the basis of the input voltage Vin, the output voltage Vout, and the input current Iin, and supply these four pieces of information to the outside.

[2. Coil Component (Transformer 20)]

[2.1 Configuration and Action]

A description is given here of a configuration example of a coil component that is variable in the number of turns and may be applicable to the transformer 20 (such as the isolation transformer). The coil component here may serve as a power supply circuit device in the switching power supply unit 1 illustrated by way of example in FIG. 1. A description is also given of a configuration example of a coil component complex that may include the transformer 20 serving as a first coil component and the resonance inductor Lr serving as a second coil component.

Figure 2:
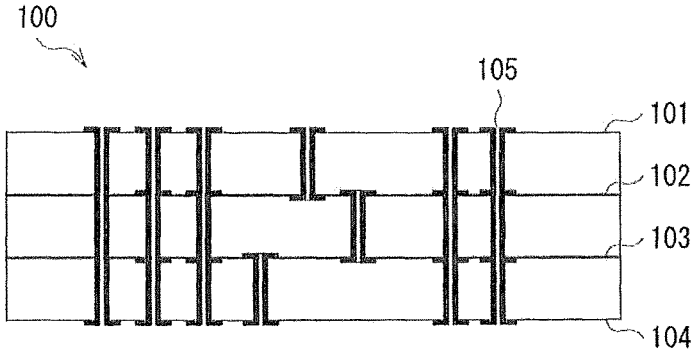
FIG. 2 is a cross-sectional view of an example of a multilayer substrate.
Figure 15:
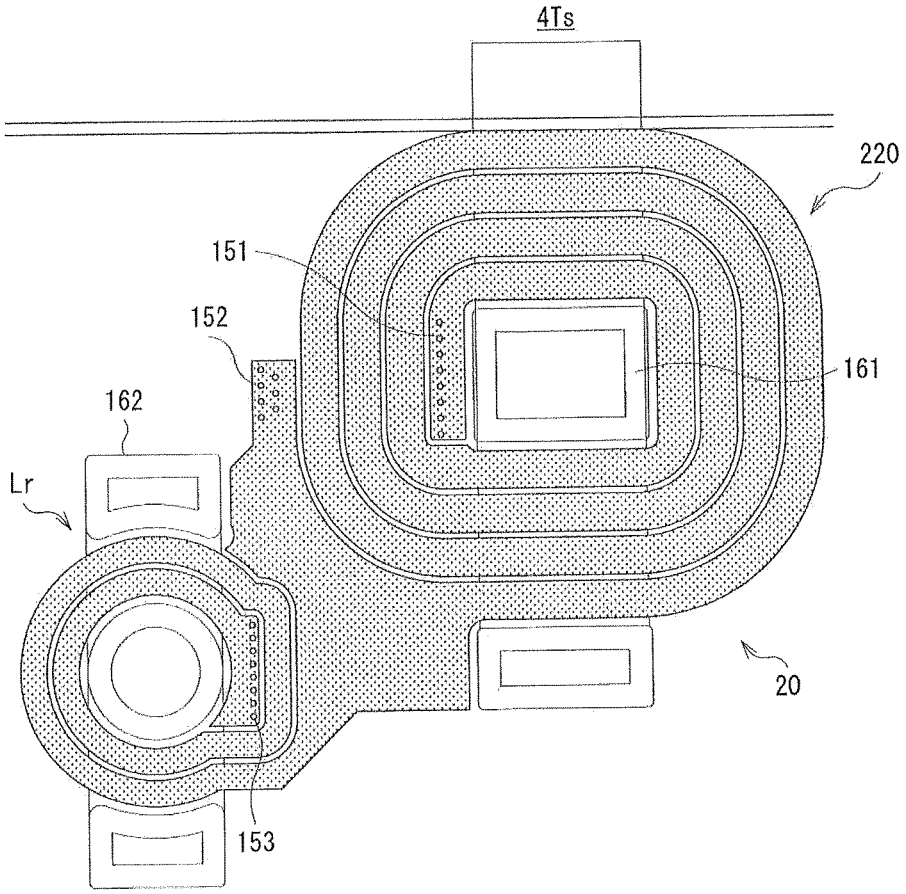
FIG. 15 is a plan view of an example in which the number of turns is fixed to four turns in a coil pattern according to the comparative example.

FIG. 15 illustrates an example of a configuration of an existing coil component configured by typical printed coil windings according to a comparative example. The printed coils may have a configuration in which copper foils, such as those of inner layers in a multilayer printed circuit board 100 illustrated by way of example in FIG. 2, are wound around later-attached magnetic cores or "cores". The copper foils of the respective layers may be coupled to one another via through-holes 105. The multilayer printed circuit board 100 illustrated in FIG. 2 may be a four-layer substrate including a first layer 101, a second layer 102, a third layer 103, and a fourth layer 104 from a surface (from an upper layer) to a lower layer. The multilayer printed circuit board 100 may allow any layer to be brought into electrical conduction with any other layer via the through-hole 105.

FIG. 15 according to the comparative example illustrates a second layer coil pattern 220 as one of the printed coil windings. The second layer coil pattern 220 may be so formed as to extend around a core 161 used for the transformer 20 (such as the isolation transformer) and around a core 162 used for the resonance inductor Lr. The cores 161 and 162 each may be, for example but not limited to, a ferrite core. The second layer coil pattern 220 wound around the core 161 illustrated in FIG. 15 may structure a part of the primary winding 21 of the transformer 20. In a step-down DC-DC converter, for a reason of potentials, the high-voltage primary winding 21 may often be provided as an inner layer and the low-voltage secondary windings 22A and 22B may often be provided as outer layers. In the example of the four-layer substrate illustrated in FIG. 2, the primary winding 21 may be configured in the second layer 102 and the third layer 103, and the secondary windings 22A and 22B may be configured in the first layer 101 and the fourth layer 104. Also, the second layer coil pattern 220 may have connection through-holes 151, 152, and 153 for providing connection with any other layer.

In the comparative example illustrated in FIG. 15, the second layer coil pattern 220 has the fixed number of turns of four turns (4 Ts) for a portion equivalent to a part of the primary winding 21 of the transformer 20. As can be seen, the number of turns of any existing printed coil winding is fixed, and it is difficult to change the number of turns easily, especially the number of turns of a winding configured in an inner layer.

In contrast, the coil component according to the present example embodiment has a configuration in which the number of turns is made variable, as illustrated in FIGS. 3 to 6 which illustrate coil patterns of such a coil component. As with the comparative example illustrated in FIG. 15, the primary winding 21 of the transformer 20 may be configured in the second layer 102 and the third layer 103, and the secondary windings 22A and 22B of the transformer 20 may be configured in the first layer 101 and the fourth layer 104 in an example embodiment of the four-layer substrate illustrated by way of example in FIG. 2. FIGS. 3 to 6 each illustrate an example of configuring the coil component complex that may include the transformer 20 serving as a first coil component and the resonance inductor Lr electrically coupled to the first coil component and serving as a second coil component.

In the following, an example of a configuration in which the four-layer substrate is used is described; however, the number of layers of a substrate on which the coil component according to the present example embodiment is formed is not limited to four layers. Also, arrangement of the coil patterns configuring the respective layers and the numbers of layers for such coil patterns are not limited to those in the configuration example to be described below.

Figure 3:
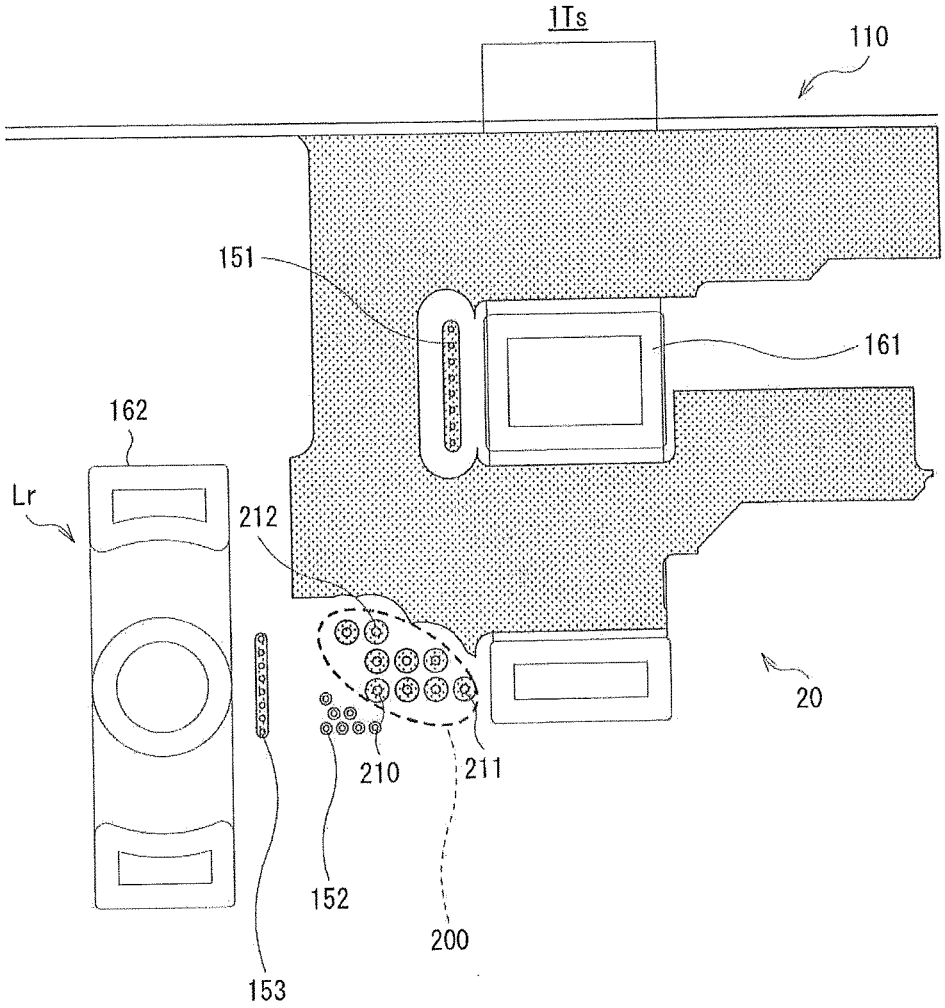
FIG. 3 is a plan view of an example of a first layer coil pattern structuring a coil component according to an embodiment of the invention.
Figure 4:
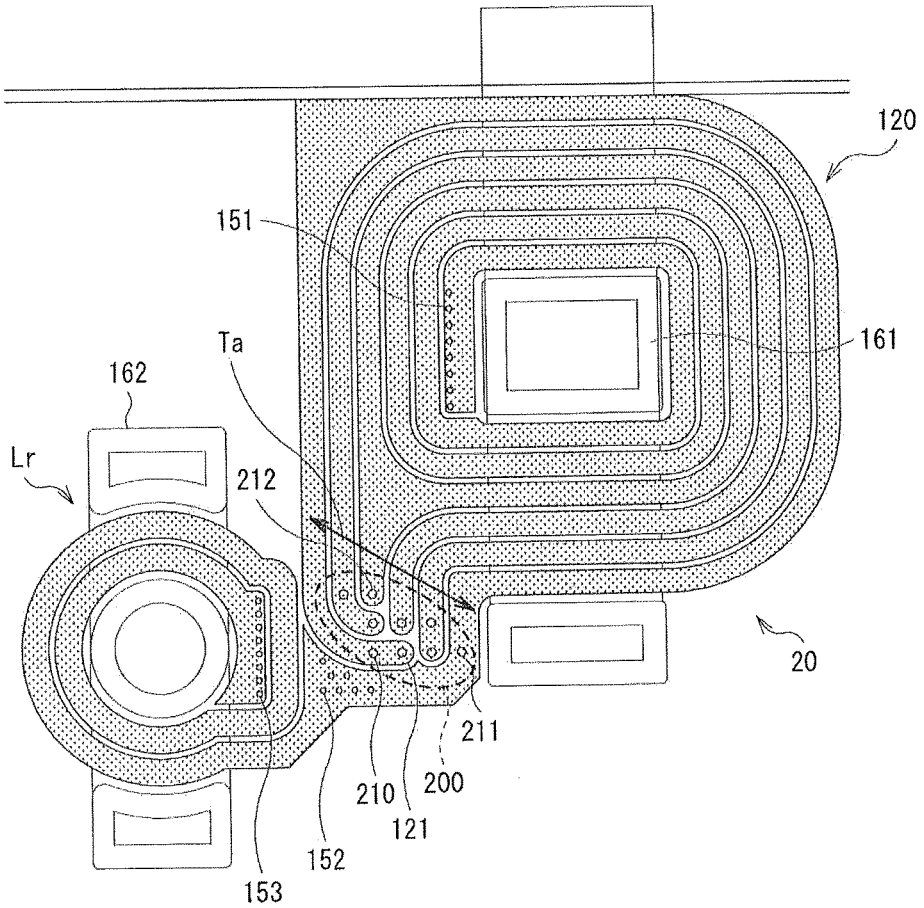
FIG. 4 is a plan view of an example of a second layer coil pattern structuring the coil component.
Figure 5:
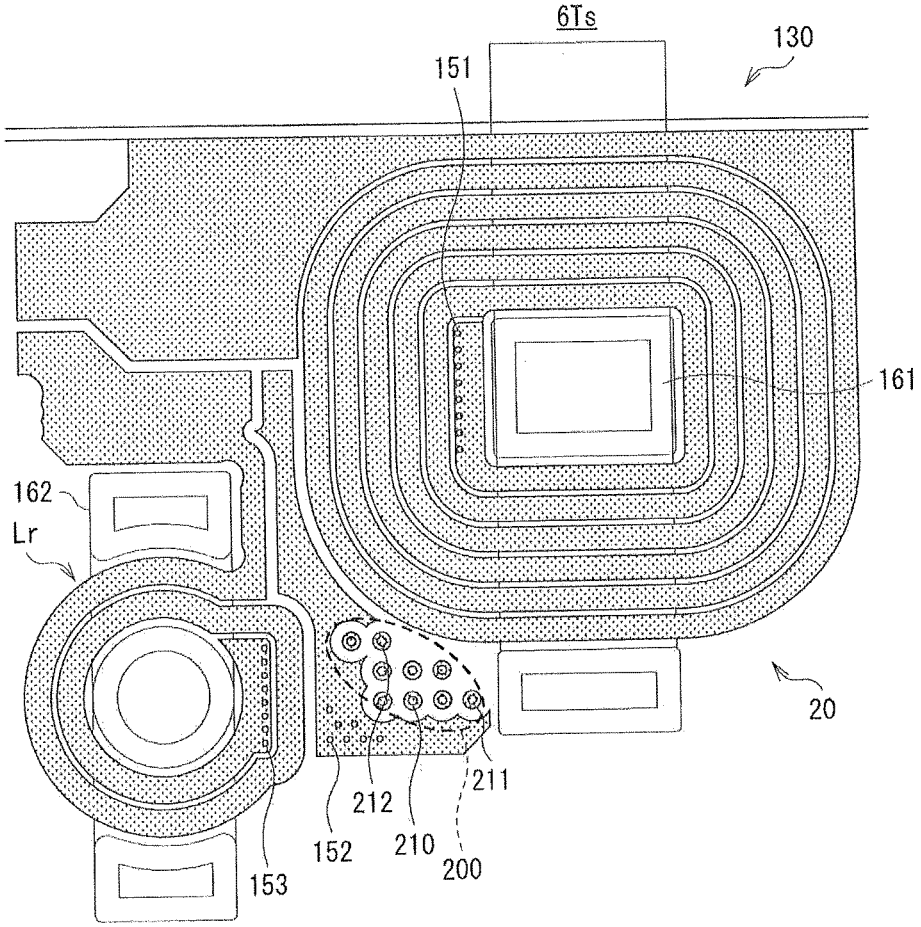
FIG. 5 is a plan view of an example of a third layer coil pattern structuring the coil component.
Figure 6:
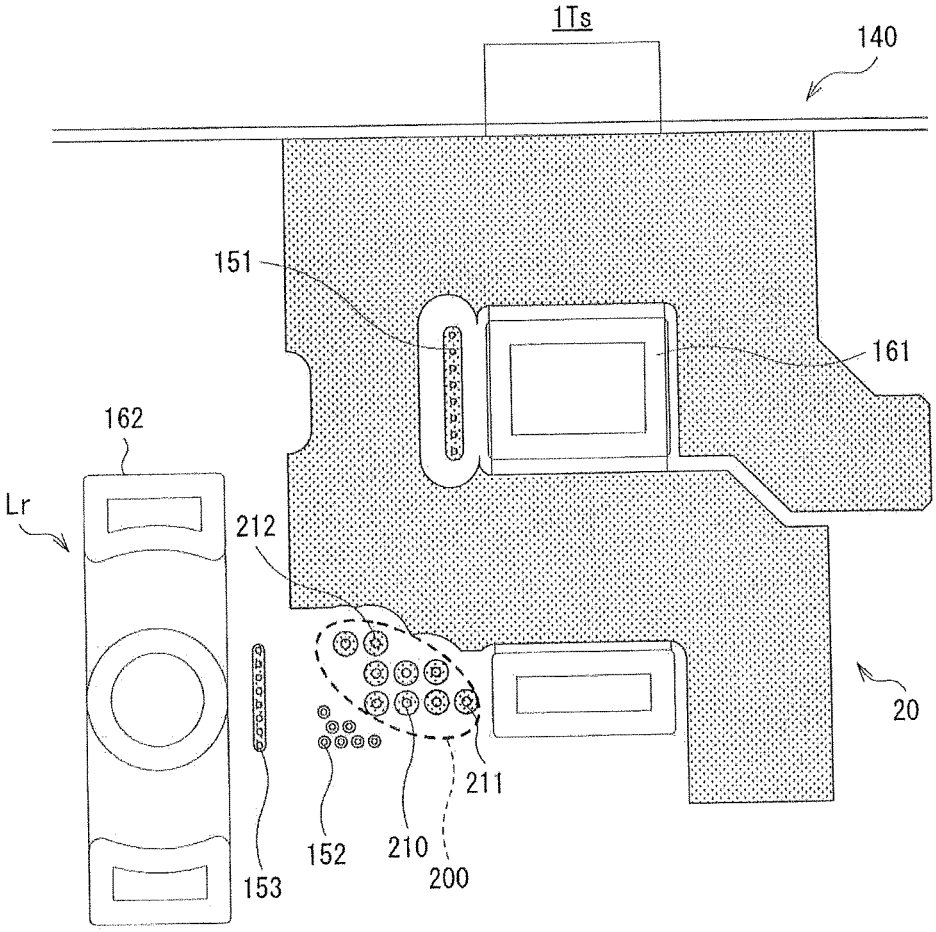
FIG. 6 is a plan view of an example of a fourth layer coil pattern structuring the coil component.

FIG. 3 illustrates an example of a first layer coil pattern 110 structuring the coil component according to an example embodiment of the invention. FIG. 4 illustrates an example of a second layer coil pattern 120, FIG. 5 illustrates an example of a third layer coil pattern 130, and FIG. 6 illustrates a fourth layer coil pattern 140, each structuring the coil component according to the example embodiment of the invention.

The coil patterns of the respective layers may be so formed as to extend around the core 161 used for the transformer 20 and around the core 162 used for the resonance inductor Lr. Each layer may have the connection through-holes 151, 152, and 153 for providing connection with any other layer.

The second layer coil pattern 120 and the third layer coil pattern 130 may be coupled to each other via the connection through-holes 151, structuring a winding section that is equivalent to the primary winding 21 of the transformer 20. Also, the second layer coil pattern 120 and the third layer coil pattern 130 may be coupled to each other via the connection through-holes 153, structuring a winding section that is equivalent to the resonance inductor Lr. The winding section equivalent to the primary winding 21 of the transformer 20 and the winding section equivalent to the resonance inductor Lr are coupled to each other via the connection through-holes 152.

In the coil component according to the present example embodiment, the section equivalent to the primary winding 21 of the transformer 20 may be provided with a turn variable section 200 that varies the number of turns. The turn variable section 200 may have turn-selection through-holes 210. The second layer coil pattern 120 includes a plurality of separated end sections 121. The separated end sections 121 are separated from each other with a gap in between.

Figure 7:
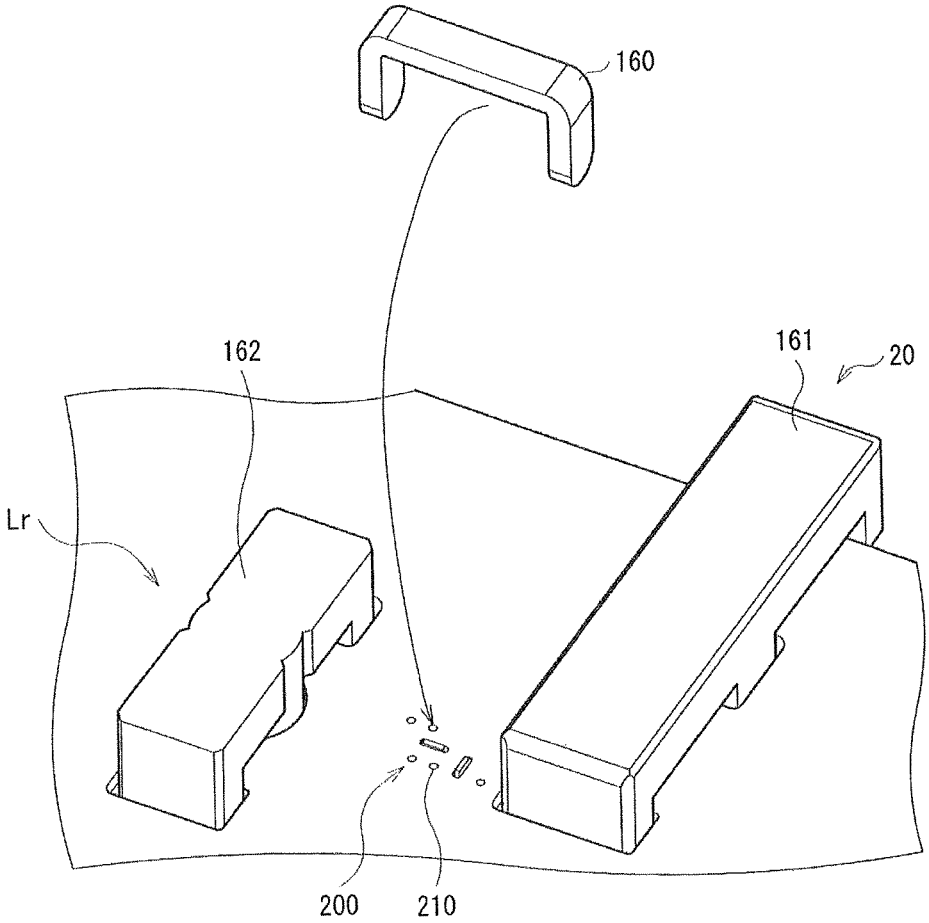
FIG. 7 is a perspective view of an example of mounting of cores and a jumper terminal.

Referring to FIG. 7, in the coil component, a jumper terminal 160 as a non-limiting example of a "conduction member" may be inserted into the turn-selection through-holes 210 from a surface layer (from the first layer) of the substrate, making it possible to change electrical conduction states of the respective separated end sections 121 via the turn-selection through-holes 210. In other words, the jumper terminal 160 allows a selective electrical conduction between the respective separated end sections 121. The selective electrical conduction causes a change in the number of turns of the second layer coil pattern 120. The jumper terminal 160 may be adapted to be provided on the surface layer, or on and from the surface layer into the turn-selection through-holes 210, to make a conduction bridge between one of the turn-selection through-holes 210 in one of the separated end sections 121 and one of the turn-selection through-holes 210 in another of the separated end sections 121. The conduction bridge allows for the selective electrical conduction between the respective separated end sections 121. Hence, it is possible to vary the number of turns of the second layer coil pattern 120 as described later with reference to FIGS. 8 to 10. Upon the variation in the number of turns of the second layer coil pattern 120, all of the patterns in the second layer coil pattern 120 serve as a coil irrespective of the variation in the number of turns by the conduction member. In other words, every section in the coil pattern 120 configures a part of the coil component, irrespective of the number of turns.

The plurality of separated end sections 121 may be provided between the transformer 20 serving as the first coil component and the resonance inductor Lr serving as the second coil component.

The second layer coil pattern 120 may have three or more turn-selection through-holes 210 in a turn-variable region Ta of the second layer coil pattern 120. In other words, the separated end sections 121 have, as a whole, three or more turn-selection through-holes 210. Preferably, the mutually-adjacent turn-selection through-holes 210 may be provided at substantially regular intervals.

In the turn-variable region Ta of the second layer coil pattern 120, a starting part of a turn of the patterns, or a "turn-starting separated end section", and an ending part of the turn of the patterns, or a "turn-ending separated end section", each may have only one turn-selection through-hole 210. In other words, in the turn-variable region Ta, the turn-starting separated end section of the second layer coil pattern 120 may be formed with one turn-selection through-hole 211, and the turn-ending separated end section of the second layer coil pattern 120 may be formed with one turn-selection through-hole 212, as illustrated in FIG. 4. Also, in the turn-variable region Ta, one or more parts of the separated end sections 121 other than the turn-starting separated end section and the turn-ending separated end section may be formed with the plurality of (two or more) turn-selection through-holes.

FIG. 7 illustrates an example of mounting of the cores 161 and 162 and the jumper terminal 160. To use the coil component as the isolation transformer, the jumper terminal 160 may be coupled based on the arrangement of the turn-selection through-holes 210. Referring to FIG. 7, the jumper terminal 160 may be mounted on the surface layer of the substrate, following which the layers from the first layer to the fourth layer may be subjected to a solder connection, for example. The jumper terminal 160 may be preferably mounted based on automatic mounting, although the jumper terminal 160 does not limit a mounting method thereof. A large current flows even in the primary side in the in-vehicle DC-DC converter, and hence a combination of a metal jumper and the solder mounting allows for an increase in a current tolerance more than that of a case where the through-holes are used alone.

Also, in terms of manufacturing and inspection, the surface layer of the substrate may be marked with any symbol with use of screen printing or any other suitable printing method, to indicate which turn-selection through-holes 210 the jumper terminal 160 should be inserted for configuring the intended number of turns.

Figure 8:
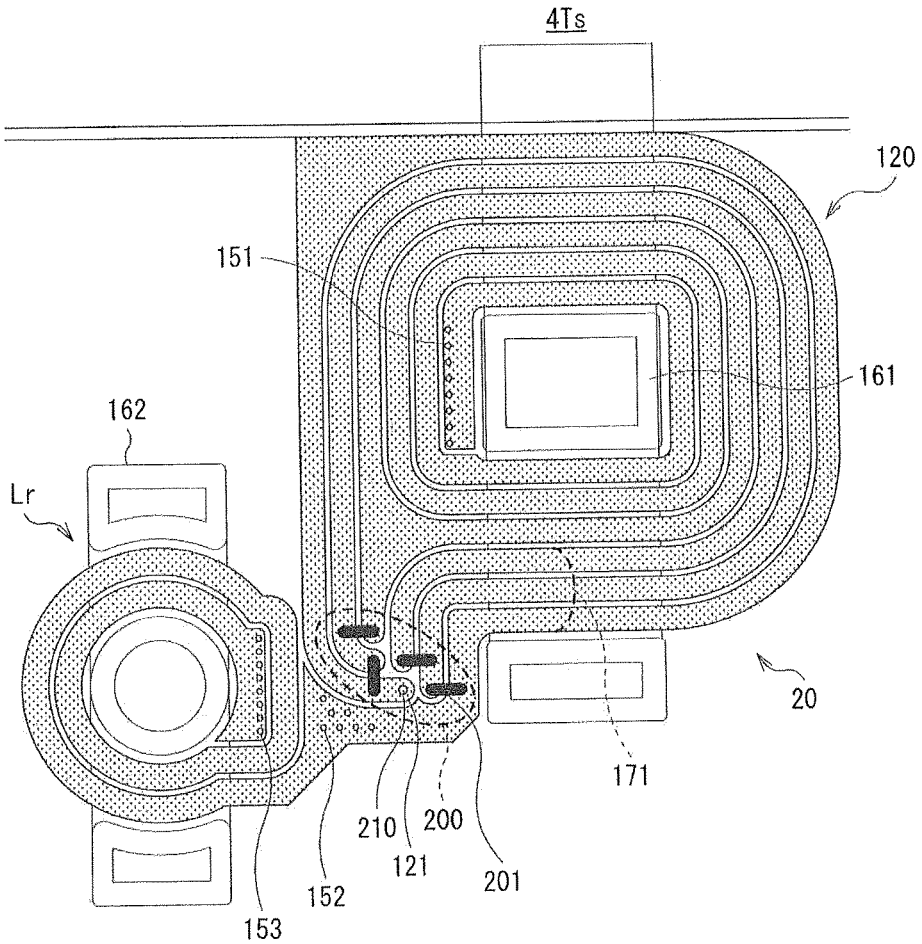
FIG. 8 is a plan view of a connection in the second layer coil pattern in an example where the number of turns of four turns is selected.
Figure 9:
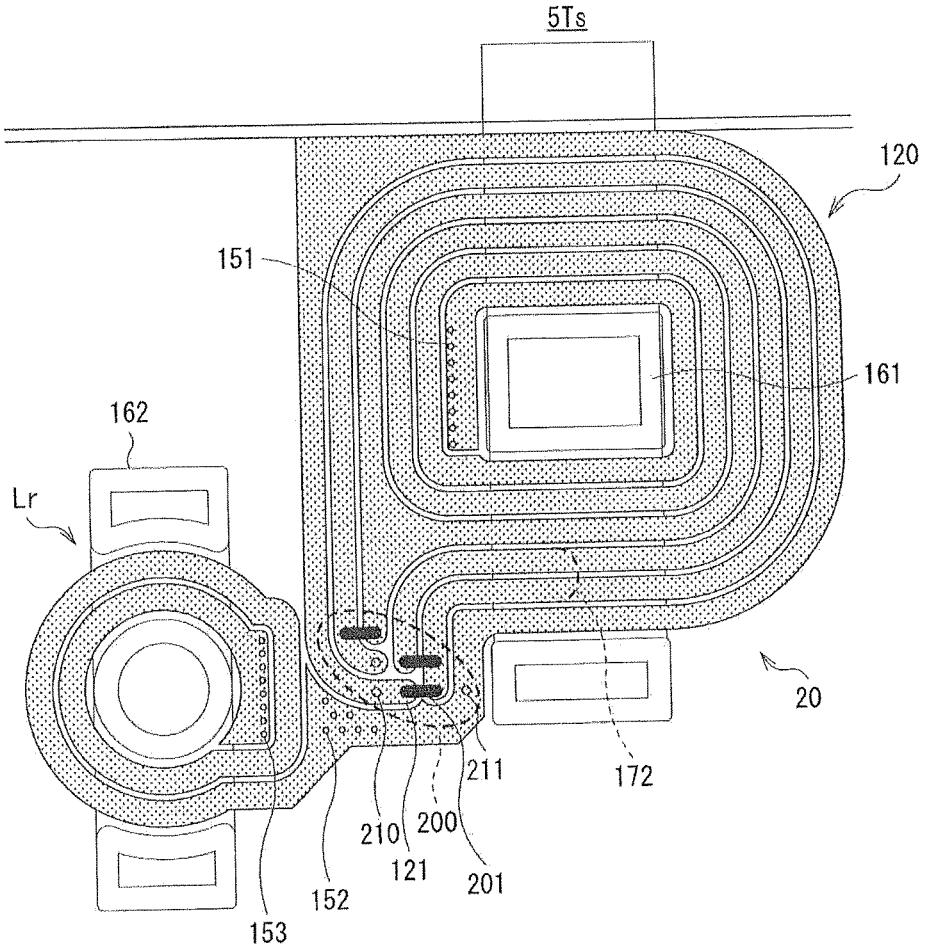
FIG. 9 is a plan view of a connection in the second layer coil pattern in an example where the number of turns of five turns is selected.
Figure 10:
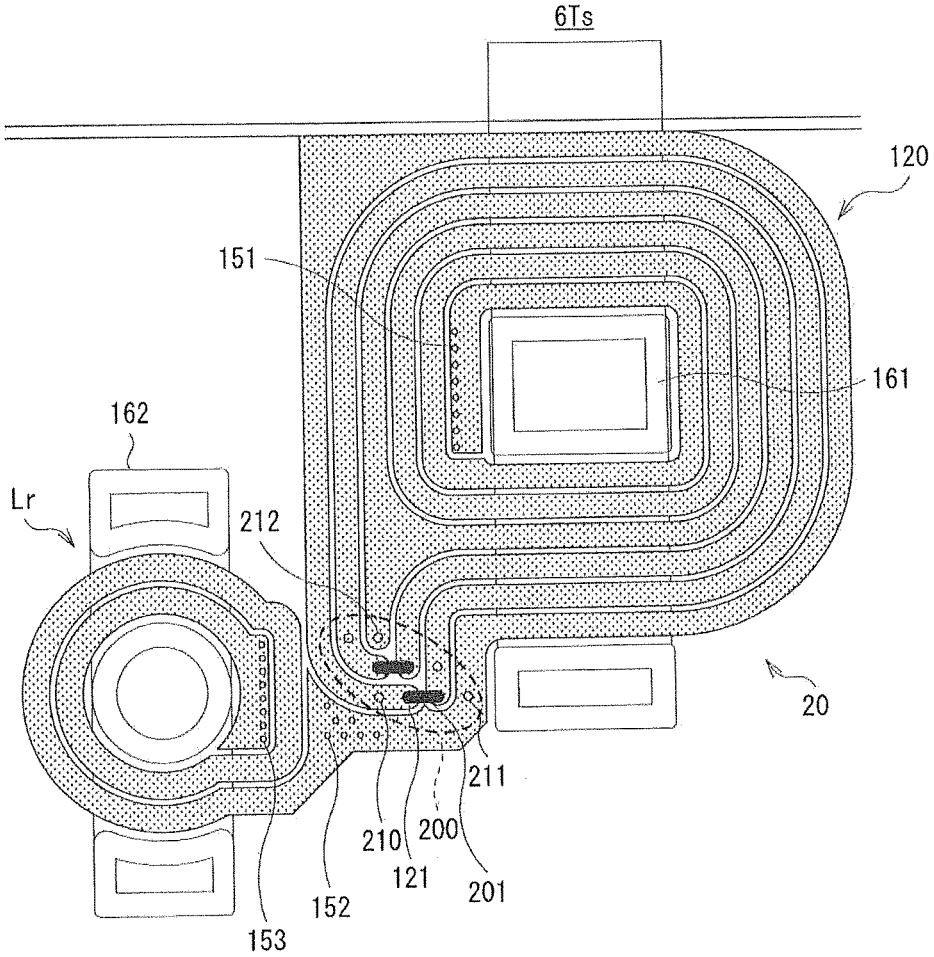
FIG. 10 is a plan view of a connection in the second layer coil pattern in an example where the number of turns of six turns is selected.

FIGS. 8 to 10 illustrate some examples of connection arrangement of the jumper terminals 160 when varying the number of turns in a range from four turns to six turns. FIG. 8 illustrates a connection in the second layer coil pattern 120 in an example where the number of turns of four turns is selected. FIG. 9 illustrates a connection in the second layer coil pattern 120 in an example where the number of turns of five turns is selected. FIG. 10 illustrates a connection in the second layer coil pattern 120 in an example where the number of turns of six turns is selected.

Referring to FIGS. 8 to 10, sections of the turn-selection through-holes 210 connected in thick black line are equivalent to connection positions 201 of the jumper terminal 160 where electrical conduction is established. In the example of four turns as illustrated in FIG. 8, patterns 171 integrated by the jumper terminal 160 are partially formed. Likewise, patterns 172 integrated by the jumper terminal 160 are partially formed in the example of five turns as illustrated in FIG. 9. Hence, all of the patterns in the second layer coil pattern 120 serve as a coil irrespective of the variation in the number of turns, without causing any wasted pattern. The intervals or "pitches" of the turn-selection through-holes 210 to which the jumper terminals 160 are to be coupled may be made substantially the same as one another to allow a single kind of jumper terminals 160 to be used.

In the coil component according to the present example embodiment, the turn variable section 200 for varying the number of turns may be provided between the transformer 20 that serves as the first coil component and the resonance inductor Lr that serves as the second coil component. Hence, it is possible to vary the number of turns without causing interference to the winding in any other layer.

[Examples of Connection Other than Use of Jumper Terminal 160]

FIG. 7 illustrates one example of selecting the number of turns with use of the conductive jumper terminals 160. Alternatively, bidirectional switching devices may be used to select the number of turns. The switching device may be, for example but not limited to, a semiconductor relay.

Figure 11:
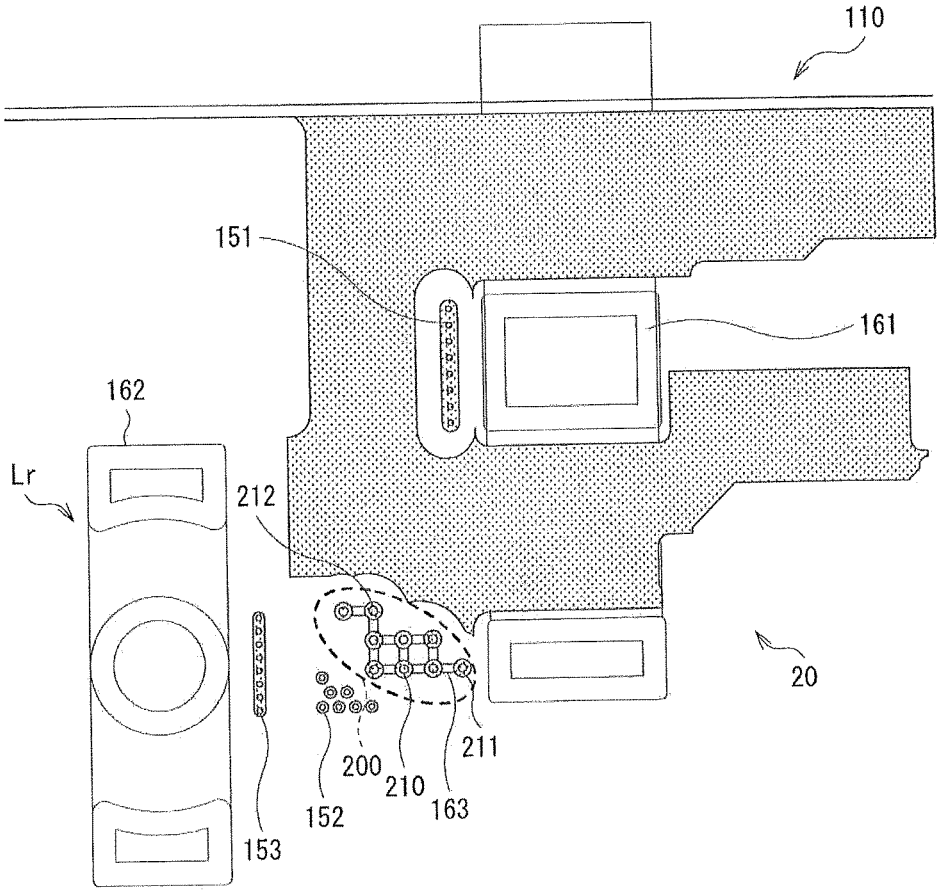
FIG. 11 is a plan view of an example of a configuration in which the selection of the number of turns of the coil pattern is performed using switching devices.

FIG. 11 illustrates an example of a configuration in which the selection of the number of turns in the second layer coil pattern 120 is performed using switching devices 163. The switching devices 163 may be provided between the turn-selection through-holes 210 in the surface layer (the first layer) of the substrate, allowing the electrical conduction states of the corresponding mutually-adjacent turn-selection through-holes 210 to be changed. A microcomputer or any other suitable computer may be used to select the number of turns on an as-needed basis. In this case, for example, the number of turns may be selected in accordance with a variation in the input voltage Vin to achieve an optimal operation (or to achieve the maximum efficiency). In one example of the DC-DC converter illustrated in FIG. 1, the turn controller 5 may control the number of turns Np of the primary winding 21 of the transformer 20 in accordance with the input voltage Vin. The number of turns may be decreased upon lowering of the input voltage Vin to allow the DC-DC converter to operate to the limit even under circumstances in which the in-vehicle HV battery is discharged. Hence, it is possible to make a contribution to expansion of a traveling distance when any embodiment of the invention is applied to a vehicle such as, but not limited to, an electric vehicle.

Also, the coil component according to the present example embodiment allows the number of turns of the second layer coil pattern 120 to be varied in a range from, for example but not limited to, four turns to six turns as illustrated by way of example in FIGS. 8 to 10. For example, if the number of turns of the winding in the third layer equivalent to the primary winding 21 of the transformer 20 is six turns, it is possible to make the number of turns of the primary winding 21 of the transformer 20 variable from 10 turns to 12 turns as a whole. Hence, it is possible to support two kinds of HV batteries that have their respective voltages ranging from 200 V to 300 V and from 300 V to 400 V as illustrated by way of example in FIG. 16.

Figure 12:
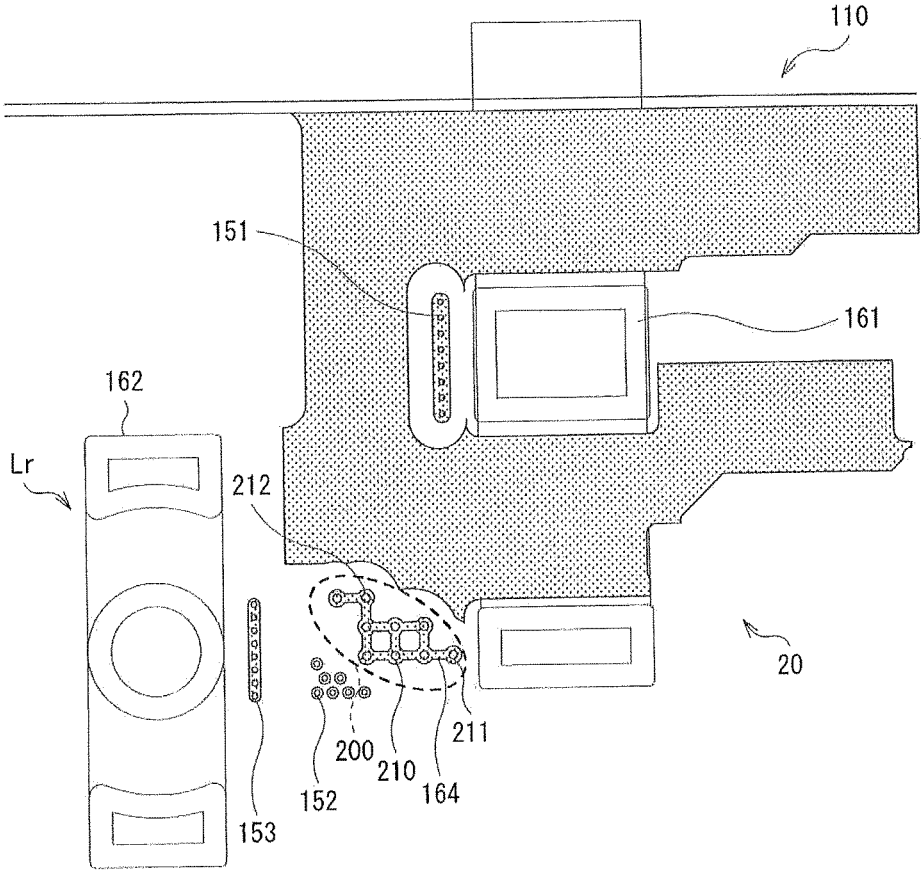
FIG. 12 is a plan view of an example of a configuration in which the selection of the number of turns of the coil pattern is performed using connection conductors.

FIG. 12 illustrates an example of a configuration in which the selection of the number of turns of the coil pattern is performed using connection conductors 164. The connection conductors 164 may be, for example but not limited to, conductor patterns. For example, referring to FIG. 12, the plurality of turn-selection through-holes 210 in the surface layer (the first layer) of the substrate may all be brought into electrical conduction with each other by the conductor pattern connection conductors 164. Any pattern of the connection conductor 164 may be cut by means of a laser cutter or any other suitable way in accordance with the number of turns to be selected, allowing for the selection of the desired number of turns.

[2.2 Effect]

According to the foregoing present example embodiment, the separated end sections 121 are brought into electrical conduction with each other selectively to vary the number of turns of the second layer coil pattern 120. Upon the variation in the number of turns of the second layer coil pattern 120, every section in the second layer coil pattern 120 configures a part of the coil component, irrespective of the number of turns. Hence, it is possible to vary the number of turns easily, without the necessity of preparing a plurality of substrates or causing a wasted pattern irrespective of the variation in the number of turns. It is also possible to increase use efficiency of a power component and improve power supplying capabilities.

Use of the coil component according to the present example embodiment makes it possible to configure the transformer having the various numbers of turns using a single kind of substrate. Hence, it is possible to support various input voltage ranges by a single kind of substrate, and thereby to achieve together factors such as, but not limited to, sharing of a substrate, a cost reduction resulting from the substrate sharing, and a reduced amount of design work at the same time.

The coil component according to the present example embodiment may be used as a power supply circuit device of a DC-DC converter used in an electric vehicle such as, but not limited to, an HEV. The present example embodiment of the invention uses only one patterned printed coil substrate of a single kind, and thus does not involve a plurality of kinds of coil windings as components. Also, only one of the layers may be subjected to the change in ratio of the numbers of turns, allowing an amount of change in parameters of the transformer to be small. The windings are to be connected in series, parallel, or a combination of both, making it possible to eliminate occurrence of any wasted pattern. In one embodiment where the jumper terminal 160 is used, the combination of the metal jumper terminal 160 and the solder connection (embedding) allows for an increase in a current tolerance involving the use of the through-holes.

[Comparison Between Embodiment of the Invention and Related Art]

JP-H08-69935A proposes to prepare a plurality of kinds of coils that are different in number of turns from each other at a portion that forms a printed coil, to vary the number of turns of the coil as a whole using a combination of the plurality of kinds of coils. It is therefore necessary to prepare a plurality of kinds of coil substrates that are different in number of turns from each other, and to provide a process step for joining the plurality of kinds of coil substrates. There are consequently a plurality of kinds of coil substrate main bodies, and hence JP-H08-69935A teaches away from the configuration that uses the same substrate. In contrast, the present example embodiment uses the patterns provided in advance on the substrate and varies the number of turns only by changing the connection of such patterns, and hence does not involve fabrication of a plurality of kinds of coil windings as members unlike JP-H08-69935A.

JP-H09-92537A selects and uses patterns disposed in advance on a substrate surface to adjust an inductor. JP-H09-92537A is disadvantageous in that unused patterns are wasted and thus substrate area is prevented from being utilized effectively. In contrast, in the present example embodiment, the patterns are to be connected in series, parallel, or a combination of both, making it possible to eliminate occurrence of any wasted pattern and to effectively use the substrate area.

JP3223425B divides adjacent patterns among patterns disposed on a substrate surface into two groups of a primary winding pattern and a secondary winding pattern, and performs selection of the two groups to connect patterns, thereby reducing coupling capacitance. This, however, incurs an increase in leakage inductance and reduces performance of a transformer accordingly. In contrast, the present example embodiment only varies the number of turns of the primary winding 21 to change only the ratio of the number of turns of the primary winding 21 to the number of turns of the secondary windings 22A and 22B. This allows the coupling capacitance to be constant between the primary side and the secondary side, and allows the leakage inductance of the transformer to be fixed at a low value as well, making it possible to achieve stable design. Also, JP3223425B describes that the change in the connection of the patterns may be performed on different faces to make a ratio of the numbers of turns of the transformer variable. The present example embodiment also differs from JP3223425B in that the change in connection of the patterns in the present example embodiment is performed only on the same single face to change the ratio of the numbers of turns.

JP2013-26556A prepares a plurality of substrates in each of which a printed coil is to be formed, and stacks those substrates to fabricate coil windings. During the fabrication, a way of connection of the windings is varied based on a jumper resistor, etc., to vary the numbers of turns of the stacked coil windings. In contrast, the present example embodiment varies the number of turns by changing the connection of the patterns located only in one of the layers of the single substrate without stacking the plurality of substrates, and hence eliminates the necessity of preparing the plurality of substrates and stacking the substrates.

H03-183106A inserts a metal pin into through-holes and performs soldering to reinforce mechanical coupling of a plurality of substrates. In contrast, the present example embodiment uses the jumper terminal and the solder connection solely for the purpose of varying the number of turns through the changing of the connection of the coil patterns located only in one of the layers of the single substrate and increasing the current tolerance at the through-holes, and differs from H03-183106A in that the present example embodiment is not directed to changing of strength of mechanical coupling.

[3. Modification Example of Coil Component]

In the example embodiment described above, described is an example of the configuration in which the number of turns of the second layer coil pattern 120 is varied. Alternatively, the number of turns of the coil pattern in any other layer may be made variable.

Figure 13:
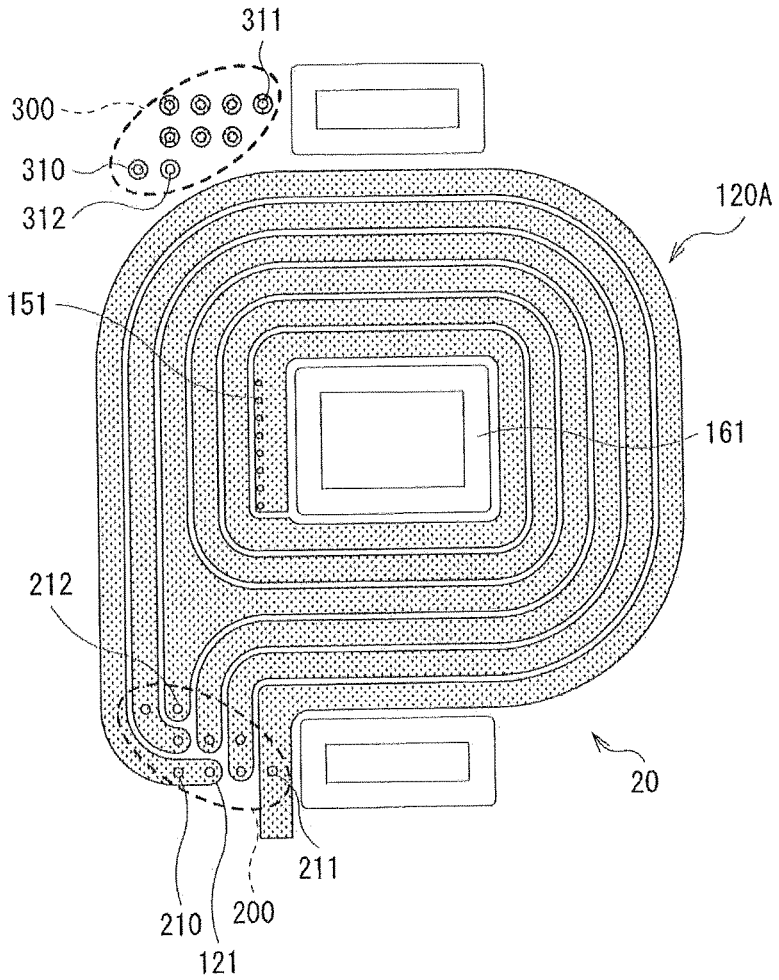
FIG. 13 is a plan view of an example of a second layer coil pattern in the coil component according to a modification example.
Figure 14:
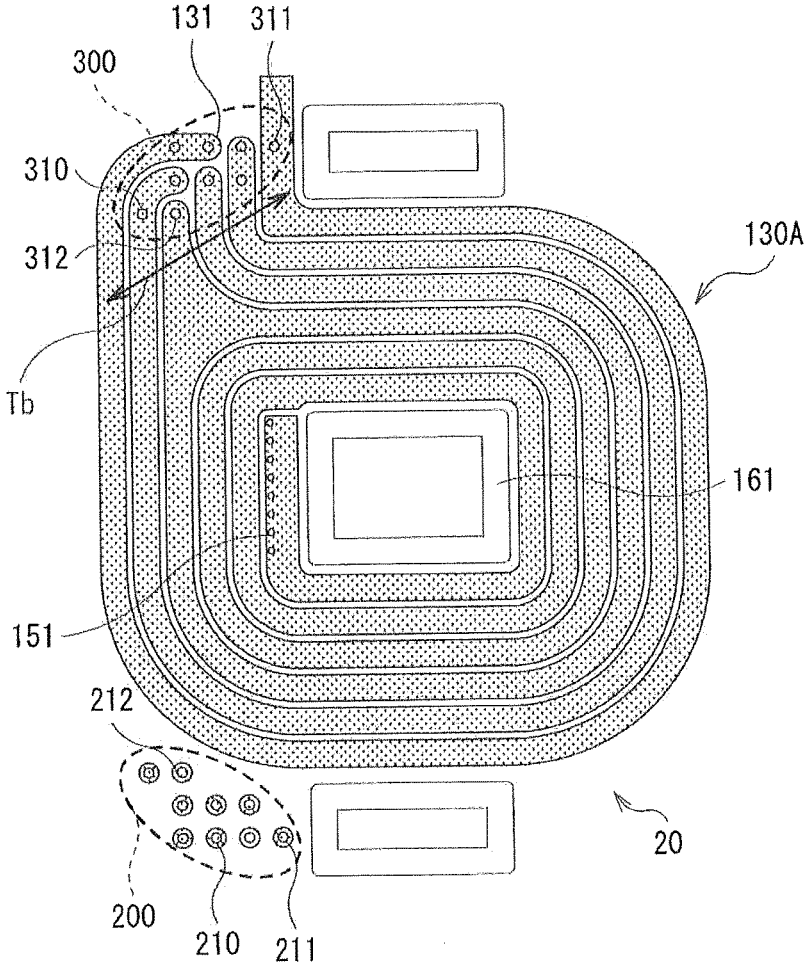
FIG. 14 is a plan view of an example of a third layer coil pattern in the coil component according to the modification example.

For example, referring to FIGS. 13 and 14, both the number of turns of a second layer coil pattern 120A and the number of turns of a third layer coil pattern 130A which are equivalent to the primary winding 21 of the transformer 20 may be made variable. FIG. 13 illustrates an example of the second layer coil pattern 120A in the coil component according to the present modification example. FIG. 14 illustrates an example of the third layer coil pattern 130A in the coil component according to the present modification example.

In the second layer coil pattern 120A, a section equivalent to the primary winding 21 of the transformer 20 may be provided with the turn variable section 200 that varies the number of turns as with the example embodiment described above.

In the third layer coil pattern 130A, a section equivalent to the primary winding 21 of the transformer 20 may be provided with a turn variable section 300 that varies the number of turns as with the second layer coil pattern 120A. The turn variable section 300 may have turn-selection through-holes 310. The third layer coil pattern 130A includes a plurality of separated end sections 131. The separated end sections 131 are separated from each other with a gap in between.

In the coil component according to the present modification example, the jumper terminal 160 as a non-limiting example of the "conduction member" may be inserted into the turn-selection through-holes 210 from the surface layer (from the first layer) of the substrate as with the example embodiment described by way of example in FIG. 7, making it possible for the third layer coil pattern 130A to change electrical conduction states of the respective separated end sections 131 via the turn-selection through-holes 310. Hence, it is possible to vary the number of turns of the third layer coil pattern 130A as with the example embodiment illustrated in FIGS. 8 to 10. Upon the variation in the number of turns of the third layer coil pattern 130A, all of the patterns in the third layer coil pattern 130A serve as a coil irrespective of the variation in the number of turns by the conduction member.

The third layer coil pattern 130A may have three or more turn-selection through-holes 310 in a turn-variable region Tb of the third layer coil pattern 130A. In other words, the plurality of separated end sections 131 have, as a whole, three or more turn-selection through-holes 310. Preferably, the mutually-adjacent turn-selection through-holes 310 may be provided at substantially regular intervals.

In the turn-variable region Tb of the third layer coil pattern 130A, the turn-starting separated end section and the turn-ending separated end section of the patterns each may have only one turn-selection through-hole 310. In other words, in the turn-variable region Tb, the turn-starting separated end section of the third layer coil pattern 130A may be formed with one turn-selection through-hole 311, and the turn-ending separated end section of the third layer coil pattern 130A may be formed with one turn-selection through-hole 312, as illustrated in FIG. 14. Also, in the turn-variable region Tb, one or more parts of the separated end sections 131 other than the turn-starting separated end section and the turn-ending separated end section may be formed with the plurality of (two or more) turn-selection through-holes.

[4. Other Embodiments]

Although the invention has been described in the foregoing by way of example with reference to the example embodiments and the modification examples, the technology of the invention is not limited thereto but may be modified in a wide variety of ways.

For example, in the example embodiments and the modification examples, described is an example in which the coil component is applied to a power supply circuit device. However, the coil component, the coil component complex, and the transformer according to the example embodiments and the modification examples of the invention are each applicable to any device, besides the power supply circuit device. Also, the coil component according to the example embodiments and the modification examples of the invention is applicable to any device such as, but not limited to, an inductor, besides the transformer.

Furthermore, the invention encompasses any possible combination of some or all of the various embodiments and the modification examples described herein and incorporated herein.

It is possible to achieve at least the following configurations from the above-described example embodiments and the modification examples of the disclosure.

(1) A coil component, including:
- a coil pattern provided on a substrate and including a plurality of separated end sections, the separated end sections being separated from each other with a gap in between; and
- a conduction member that allows a selective electrical conduction between the respective separated end sections, the selective electrical conduction causing a change in the number of turns of the coil pattern, wherein
- every section in the coil pattern configures a part of the coil component, irrespective of the number of turns.

(2) The coil component according to (1), wherein
- the substrate includes a multilayer substrate including a surface layer and one or more inner layers,
- the coil pattern is provided in one or more of the inner layers of the multilayer substrate,
- each of the plurality of separated end sections has one or more turn-selection through-holes, and
- the conduction member is adapted to be provided on the surface layer, or on and from the surface layer into the turn-selection through-holes, to make a conduction bridge between one of the turn-selection through-holes in one of the separated end sections and one of the turn-selection through-holes in another of the separated end sections, the conduction bridge allowing for the selective electrical conduction between the respective separated end sections.

(3) The coil component according to (2), wherein
- the plurality of separated end sections include a turn-starting separated end section and a turn-ending separated end section,
- each of the turn-starting separated end section and the turn-ending separated end section has one turn-selection through-hole, and
- one or more of the separated end sections other than both the turn-starting separated end section and the turn-ending separated end section has two or more turn-selection through-holes.

(4) The coil component according to (2) or (3), wherein the plurality of separated end sections have, as a whole, three or more turn-selection through-holes that are adjacent to each other at substantially regular intervals.

(5) A transformer, including:
- a primary winding; and
- a secondary winding,
- the primary winding or the secondary winding including:
- a coil pattern provided on a substrate and including a plurality of separated end sections, the separated end sections being separated from each other with a gap in between; and
- a conduction member that allows a selective electrical conduction between the respective separated end sections, the selective electrical conduction causing a change in the number of turns of the coil pattern, wherein
- every section in the coil pattern configures a part of the coil component, irrespective of the number of turns.

(6) A coil component complex, including:
- a first coil component; and
- a second coil component electrically coupled to the first coil component,
- the first coil component including:
- a coil pattern provided on a substrate and including a plurality of separated end sections, the separated end sections being separated from each other with a gap in between; and
- a conduction member that allows a selective electrical conduction between the respective separated end sections, the selective electrical conduction causing a change in the number of turns of the coil pattern, wherein
- every section in the coil pattern configures a part of the coil component, irrespective of the number of turns.

(7) The coil component complex according to (6), wherein the separated end sections are provided between the first coil component and the second coil component on the substrate.

(8) A power supply unit, including
- a power supply circuit device configured by a coil component,
- the coil component including:
- a coil pattern provided on a substrate and including a plurality of separated end sections, the separated end sections being separated from each other with a gap in between; and
- a conduction member that allows a selective electrical conduction between the respective separated end sections, the selective electrical conduction causing a change in the number of turns of the coil pattern, wherein
- every section in the coil pattern configures a part of the coil component, irrespective of the number of turns.

(9) The power supply unit according to (8), further including
- a turn controller,
- wherein the conduction member includes a switching device, and
- the turn controller is configured to control switching of the switching device to control the number of turns.

(10) The power supply unit according to (9), wherein the turn controller controls the number of turns, based on a magnitude of an input voltage.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A coil component, comprising:

a coil pattern provided on a substrate and including a plurality of coil sections each having a respective one of a plurality of separated end sections, the separated end sections being separated from each other with a gap in between; and a conduction member that allows a selective electrical conduction between the respective separated end sections, the selective electrical conduction causing a change in the number of turns of the coil pattern, wherein each of the plurality of coil sections is electrically separate from the other ones of the plurality of coil sections, and becomes electrically connected with another one of the plurality of coil sections only when being connected with the other one of the plurality of coil sections by the conduction member, every coil section in the coil pattern configures a part of the coil component, irrespective of the number of turns, the substrate comprises a multilayer substrate including a surface layer and one or more inner layers, the coil pattern is provided in one or more of the inner layers of the multilayer substrate, each of the plurality of separated end sections has one or more turn-selection through-holes, and the conduction member is configured to be provided on selected positions of the surface layer, or on the surface layer and from the surface layer into selected turn-selection through-holes in the inner layers, to extend into the inner layers and constitute a conduction bridge between a selected one of the separated end sections in one inner layer and another selected one of the separated end sections in another inner layer, the conduction bridge allowing for selective electrical conduction between the selected one and the other selected one of the separated end sections in different inner layers.

2. The coil component according to claim 1, wherein the plurality of separated end sections include a turn-starting separated end section and a turn-ending separated end section, each of the turn-starting separated end section and the turn-ending separated end section has only one turn-selection through-hole, and one or more of the separated end sections other than both the turn-starting separated end section and the turn-ending separated end section has two or more turn-selection through-holes.

3. The coil component according to claim 1, wherein the plurality of separated end sections have, as a whole, three or more turn-selection through-holes that are adjacent to each other at substantially regular intervals.

4. The coil component according to claim 1, wherein the plurality of separated end sections have, as a whole, three or more turn-selection through-holes that are adjacent to each other at substantially regular intervals.

5. The coil component according to claim 1, wherein the coil pattern includes, depending on the number of turns, patterns that are partially connected by the conduction member.

6. The coil component according to claim 1, wherein the coil pattern includes, depending on the number of turns, patterns that are connected in series by the conduction member, patterns that are connected in parallel by the conduction member, or patterns that are connected in a combination of series connection and parallel connection by the conduction member.

7. A transformer, comprising:

a primary winding; and a secondary winding, the primary winding or the secondary winding including:

a coil pattern provided on a substrate and including a plurality of coil sections each having a respective one of a plurality of separated end sections, the separated end sections being separated from each other with a gap in between; and a conduction member that allows a selective electrical conduction between the respective separated end sections, the selective electrical conduction causing a change in the number of turns of the coil pattern, wherein each of the plurality of coil sections is electrically separate from the other ones of the plurality of coil sections, and becomes electrically connected with another one of the plurality of coil sections only when being connected with the other one of the plurality of coil sections by the conduction member, every coil section in the coil pattern configures a part of the coil component, irrespective of the number of turns, the substrate comprises a multilayer substrate including a surface layer and one or more inner layers, the coil pattern is provided in one or more of the inner layers of the multilayer substrate, each of the plurality of separated end sections has one or more turn-selection through-holes, and the conduction member is configured to be provided on selected positions of the surface layer, or on the surface layer and from the surface layer into selected turn-selection through-holes in the inner layers, to extend into the inner layers and constitute a conduction bridge between a selected one of the separated end sections in one inner layer and another selected one of the separated end sections in another inner layer, the conduction bridge allowing for selective electrical conduction between the selected one and the other selected one of the separated end sections in different inner layers.

8. The transformer according to claim 7, wherein the coil pattern includes, depending on the number of turns, patterns that are partially connected by the conduction member.

9. The transformer according to claim 7, wherein the coil pattern includes, depending on the number of turns, patterns that are connected in series by the conduction member, patterns that are connected in parallel by the conduction member, or patterns that are connected in a combination of series connection and parallel connection by the conduction member.

10. A coil component complex, comprising:

a first coil component; and a second coil component electrically coupled to the first coil component, the first coil component including:

a coil pattern provided on a substrate and including a plurality of coil sections each having a respective one of a plurality of separated end sections, the separated end sections being separated from each other with a gap in between; and a conduction member that allows a selective electrical conduction between the respective separated end sections, the selective electrical conduction causing a change in the number of turns of the coil pattern, wherein each of the plurality of coil sections is electrically separate from the other ones of the plurality of coil sections, and becomes electrically connected with another one of the plurality of coil sections only when being connected with the other one of the plurality of coil sections by the conduction member, every coil section in the coil pattern configures a part of the coil component, irrespective of the number of turns, the substrate comprises a multilayer substrate including a surface layer and one or more inner layers, the coil pattern is provided in one or more of the inner layers of the multilayer substrate, each of the plurality of separated end sections has one or more turn-selection through-holes, and the conduction member is configured to be provided on selected positions of the surface layer, or on the surface layer and from the surface layer into selected turn-selection through-holes in the inner layers, to extend into the inner layers and constitute a conduction bridge between a selected one of the separated end sections in one inner layer and another selected one of the separated end sections in another inner layer, the conduction bridge allowing for selective electrical conduction between the selected one and the other selected one of the separated end sections in different inner layers.

11. The coil component complex according to claim 10, wherein the separated end sections are provided between the first coil component and the second coil component on the substrate.

12. The coil component complex according to claim 10, wherein the coil pattern includes, depending on the number of turns, patterns that are partially connected by the conduction member.

13. The coil component complex according to claim 10, wherein the coil pattern includes, depending on the number of turns, patterns that are connected in series by the conduction member, patterns that are connected in parallel by the conduction member, or patterns that are connected in a combination of series connection and parallel connection by the conduction member.

14. A power supply unit, comprising a power supply circuit device configured by a coil component, the coil component including:

a coil pattern provided on a substrate and including a plurality of coil sections each having a respective one of a plurality of separated end sections, the separated end sections being separated from each other with a gap in between; and a conduction member that allows a selective electrical conduction between the respective separated end sections, the selective electrical conduction causing a change in the number of turns of the coil pattern, wherein each of the plurality of coil sections is electrically separate from the other ones of the plurality of coil sections, and becomes electrically connected with another one of the plurality of coil sections only when being connected with the other one of the plurality of coil sections by the conduction member, every coil section in the coil pattern configures a part of the coil component, irrespective of the number of turns, the substrate comprises a multilayer substrate including a surface layer and one or more inner layers, the coil pattern is provided in one or more of the inner layers of the multilayer substrate, each of the plurality of separated end sections has one or more turn-selection through-holes, and the conduction member is configured to be provided on selected positions of the surface layer, or on the surface layer and from the surface layer into selected turn-selection through-holes in the inner layers, to extend into the inner layers and constitute a conduction bridge between a selected one of the separated end sections in one inner layer and another selected one of the separated end sections in another inner layer, the conduction bridge allowing for selective electrical conduction between the selected one and the other selected one of the separated end sections in different inner layers.

15. The power supply unit according to claim 14, further comprising a turn controller, wherein the conduction member comprises a switching device, and the turn controller is configured to control switching of the switching device to control the number of turns.

16. The power supply unit according to claim 15, wherein the turn controller controls the number of turns, based on a magnitude of an input voltage.

* * * * *